United States Patent [19]

Erlandson

[11] Patent Number: 4,682,532

[45] Date of Patent: Jul. 28, 1987

[54] VARIABLE-STROKE CONSTANT-COMPRESSION-RATIO REVERSIBLE RADIAL PUMP

[76] Inventor: Erik E. Erlandson, 12814 Amaranth Street, San Diego, Calif. 92129

[21] Appl. No.: 689,367

[22] Filed: Jan. 7, 1985

[51] Int. Cl.[4] ..... F01B 31/14

[52] U.S. Cl. ..... 92/13.7; 74/25; 74/117; 74/571 R; 74/835; 74/842; 92/140

[58] Field of Search ..... 92/13.1, 13.3, 13.7, 92/140; 74/25, 117, 571 R, 835, 836, 842

[56] References Cited

U.S. PATENT DOCUMENTS

| | | | |
|---|---|---|---|
| 3,398,691 | 8/1968 | Sato | 92/13.7 |
| 3,906,842 | 9/1975 | Sonobe | 92/13.1 |
| 4,485,768 | 12/1984 | Heniges | 92/13.1 |

*Primary Examiner*—Abraham Hershkovitz
*Attorney, Agent, or Firm*—Charmasson & Holz

[57] ABSTRACT

A variable-stroke, constant-compression, reversible radial pump, the stroke of which may be infinitely adjusted by means of a variable-throw eccentric from a normal-cycle maximum through zero to a reverse-cycle maximum, and the compression of which is maintained constant through the use of a variable-geometry cylinder-head assembly. The cylinder geometry varies when the cylinder head is raised and lowered by means of a synchronized screw arrangement which is coupled through a gear set to the variable-throw eccentric. The variable throw-eccentric comprises a hollow input shaft which is drilled and threaded diametrically. A threaded, splined adjustment shaft is screwed into the threaded diametric hole in the input shaft. Each end of the adjustment shaft is mounted in bearing races which are anchored at diametrically opposed points in a connecting-rod journal. The adjustment shaft may be rotated by means of a rack gear which slides back and forth within the hollow portion of the input shaft and operates on the splines of said adjustment shaft. As the threaded, splined shaft is rotated, the position of the journal with respect to the input shaft is changed, which equates with a change in drive eccentricity and stroke of the pump.

4 Claims, 6 Drawing Figures

FIG. 1
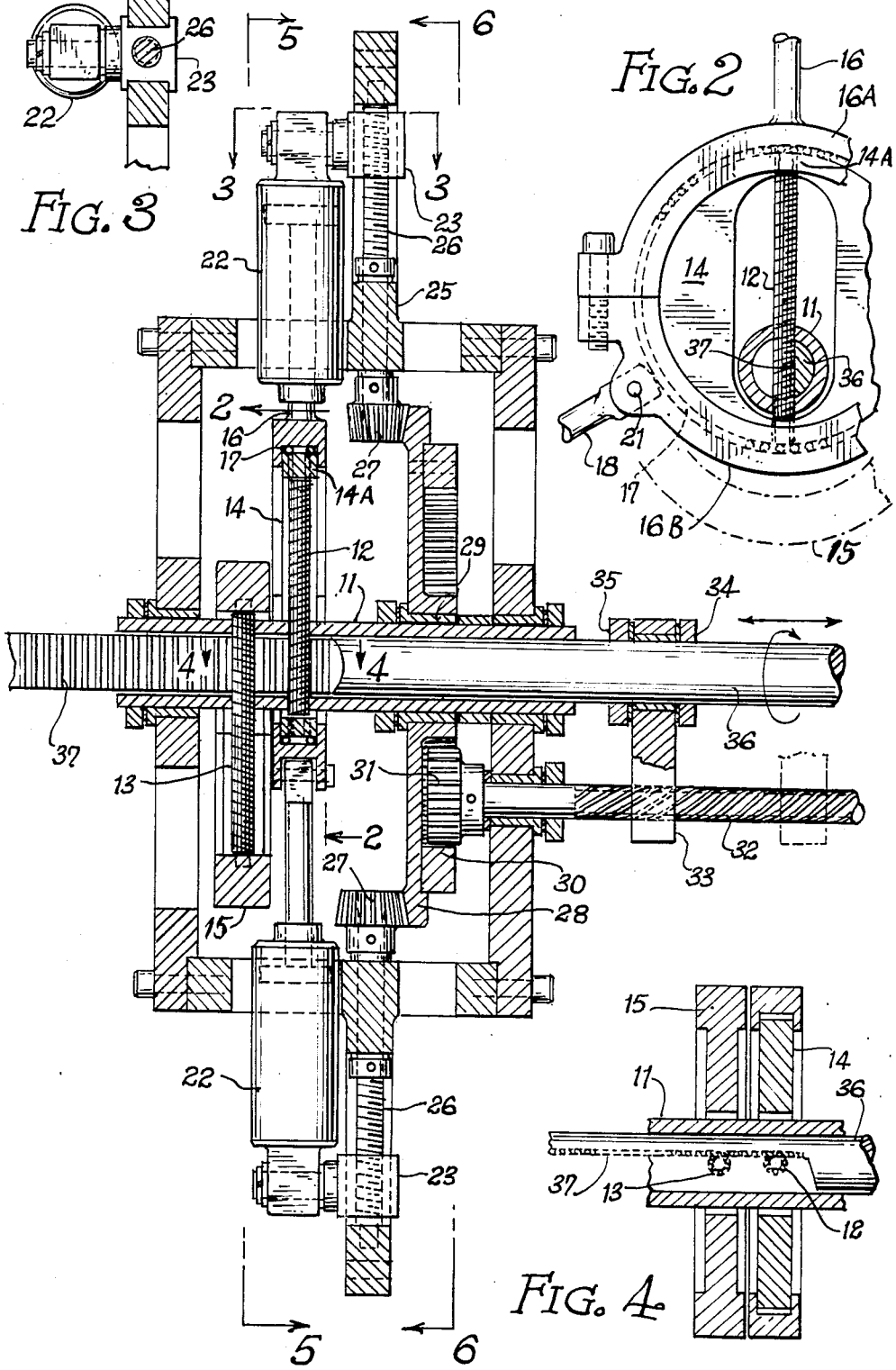
FIG. 2
FIG. 3
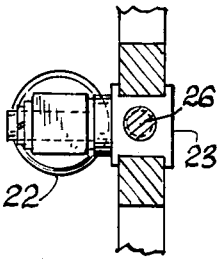
FIG. 4

VARIABLE-STROKE CONSTANT-COMPRESSION-RATIO REVERSIBLE RADIAL PUMP

FIELD OF THE INVENTION

This invention relates to reversible pumps, variable-stroke, constant-compression-ratio pumps, adjustable-throw eccentrics and threaded, splined shafts.

BACKGROUND OF THE INVENTION

Eccentrics have long been used for converting rotary motion into reciprocatory motion and vice versa. Varialbe eccentrics generally consist of two juxtaposed, eccentric members mounted on a drive shaft. As the outer eccentric is rotated about the inner eccentric, the eccentricity changes. If both members have identical eccentricity, the eccentricity may be varied from zero to a maximum and back to zero. Locking of the eccentric members in normally accomplished with pins, locks or bolts. A method for varying the throw of the eccentric while it is in rotary or angular motion is taught in U.S. Pat. No. 4,249,424, issued to William J. Glazier on Feb. 10, 1981. Glazier uses a geared control shaft which is coaxial with the drive shaft and which is coupled through an idler gear to gearing on the inner surface of the outer eccentric.

A variable-throw eccentric constructed from two juxtaposed eccentric members necessarily undergoes a phase change through 180 degrees as the outer eccentric is rotated. This characteristic complicates the design of pumps, motors or engines which rely of sychronized valve timing. A variable-throw constant-phase eccentric would be advantageous in such applications.

In pump, motor or engine applicaions, a variable-throw eccentric poses an additional problem. As the stroke is reduced, the compression-ratio is also reduced. Efficient use of the variable-throw eccentric in such applications would neccessitate the development of a means for maintaining a constant or nearly-constant compression ratio as the stroke is changed. A pump, motor or engine with varialbe stroke and constant compression would actually be able to "shrink" as the load or output requirements varied. The shrinkage would reduce friction and thermal losses. A primitive attempt at shrinking an engine as the load decreased was made by General Motors Corporation. In the early eighties, certain cadillac automobiles were equipped with V-8 engines in which the intake valves of up to four clinders could be deactivated as the load on the engine decreased. Of course, deactivated cylinders continued to consume power through frictional losses. Although some increase in efficiency was achieved, the design proved to be unreliable and was subsequently withdrawn from the market.

Multiple variable-throw eccentrics could also be harnessed in a variable-speed transmission. If the phase could be maintained constant as the eccentric varied from a maximum to zero, the phase would completely reverse upon passing through the null point. Thus, without changing pump valving, both forward and reverse speeds, as well as a neutral position, could be achieved with a signle set of variable-throw eccentrics.

SUMMARY OF THE INVENTION

The present invention achieves a means for varying the throw of an eccentric from a normal-cycle maximum through zero to a reverse-cycle maximum while the eccentric moves circularly in continuous angular motion. The design of the disclosed variable-throw eccentric is particularly suited to reversible pump design, for as the throw of the eccentric passes through the point of zero throw, the phase changes by 180 degrees. The variable throw-eccentric comrises a hollow input shaft which is drilled and threaded diametrically. A threaded, aplined adjustment shaft is screwed into the threaded diametric hole in the input shaft. The opposite ends of said adjustment shaft are mounted in bearing races anchored at diametrically opposed points in a connecting-rod journal. The adjustment shaft may be rotated by means of s sliding rack gear mounted within the hollow of the input shaft which operates on the splines of said adjustment shaft as it moves back and forth parallel to the rotational axis of the input shaft. As the threaded, spline shaft is rotated, the position of the journal with respect to the input shaft is changed, which equates a change in drive ecentricity and stroke of the pump.

The present invention also achieves a means for maintaining the compression-ratio of the pump constant as the throw of the variable eccentric is changed. In a pump with radial cylinders, this is accomplished by means of cylinder/cylinder-head assemblies that may be raised and lowered on sliding screw-block assemblies which are coupled by means of beveled pinion gears to a beveled ring gear which rotates about input shaft. The beveled ring gear incorporates another straight-cut ring gear that is operated by a pinion mounted on a control shaft which is parallel to the rotational axis of the input shaft. The control shaft is threaded and fitted with a sliding screw block that is coupled to the end ot the rack gear which protrudes from the hollow input shaft. As the control shaft is rotated, the cylinder/cylinder-head assemblies are raised or lowered to maintain the compression ratio constant as the throw of the eccentric is varied.

The invention may be used as power transmission device if valve controlled fluid output the pump is sent to a hydraulic motor. The pulse effect may be smoothed by coupling the output of moltiple cylinders having evenly-spaced phase relationships. If pump valve timing remains constant with relationship to the input shaft, the phase of the pump and the direction of the pump output will completely reverse as the stroke passes through the null point.

As a pump, the invention may be also be used to control the position and velocity of hydraulic servo piston, locking the piston in place when the eccentric is in the null position. In pump form with two eccentrics having oppositely-threaded splined adjustment shafts and controlled by a single rack gear, the invention may also be used as a volumetric measuring device.

Although the invention is described as a pump, it can easily be adapted for use as an internal or external combustion engine or as a hydraulic motor. cl BRIEF DESCRIPTION OF THE DRAWINGS FIG. 1 is a biangular cross-sectional view of the entire device taken at line 1—1 of FIG. 5.

FIG. 2 is a detail view of the variable ecentric taken at line 2—2 of FIG. 1.

FIG. 3 is a cross-sectional view of the piston and screw-jack assembly taken at line 3—3 of FIG. 1.

FIG. 4 is a cross-sectional view at line 4—4 of FIG. 1 showing the sliding rack gear engaging the splines of the threaded, splined adjustment shafts of the counter-balanced variable-throw eccentrics.

DESCRIPTION OF THE PREFERRED EMBODIMENT OF THE INVENTION

Figure 5:
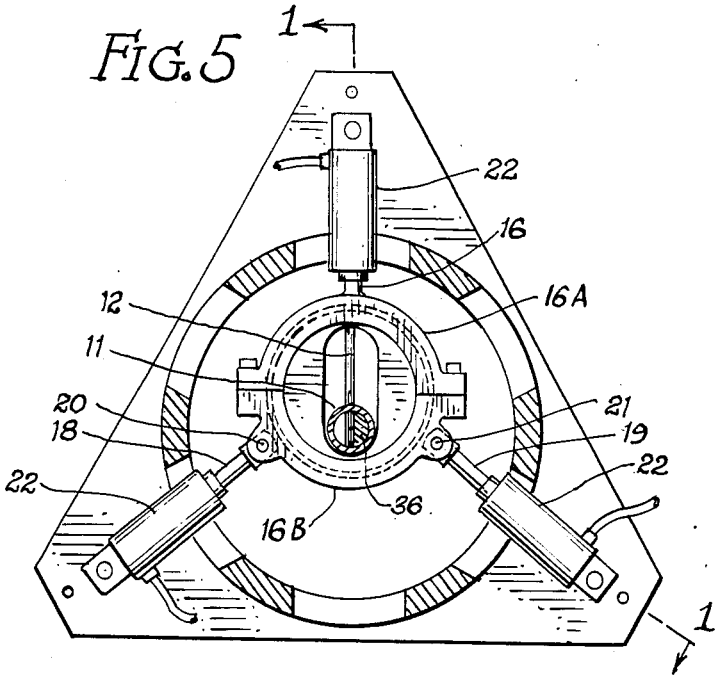
FIG. 5 is a cross-sectional view taken at line 5—5 of FIG. 1 showing the secondary connecting rods attached to the main connecting rod.

Referring now to FIG. 1, hollow input shaft 11 is drilled and threaded to accept a right-hand-threaded, splined adjustment shaft 12 and a left-hand-threaded, splined adjustment shaft 13. The opposite ends of right-hand-threaded adjustment shaft 12 are rotatably mounted at diametrically-opposite points by bearing races 14A connecting rod journal 14, while the opposite ends of left-hand-threaded adjustment shaft 13 are rotatably mounted at diametrically-opposite points in hollow counterbalance 15. Primary connecting rod 16 rides on roller bearings 17 about connecting rod journal 14.

Referring now to FIG. 5, primary connecting rod 16 is diametrically split in an upper part 16A and a lower part 16B to enable assembly and disassembly. In typical radial engine fashion, two secondary connecting rods 18 and 19 are pivotally attached to primary connecting rod 16 by pins 20 and 21. A piston (not shown) is rigidly affixed to each connecting rod and slideably mounted within an enclosed cylinder assembly 22.

Figure 6:
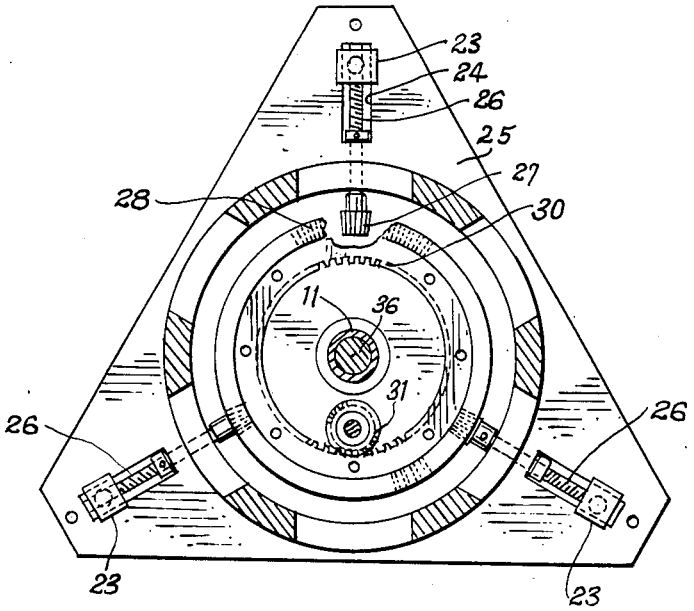
FIG. 6 is a cross-sectional view taken at line 6—6 of FIG. 1 showing the internal ring and pinion gear set.

Referring now to FIG. 6, each cylinder assembly 22 is pivotally mounted to a sliding block 23. Alternatively, each cylinder assembly could be rigidly affixed to its associated sliding screw block and the piston could be pivotally mounted on a wrist pin in a conventional manner. Each of the three sliding blocks 23 is slideably mounted in a guide slot 24 in the main support frame 25 and drilled and tapped to accept an associated threaded jack shaft 26, which is rotatably mounted to said main support frame 25 and collared to longitudinal movement. As each threaded jack shaft 26 is rotated, its associated sliding block 23 is either raised or lowered. Each threaded jack shaft 26 is fitted with a beveled pinion gear 27 which is in constant mesh with beveled ring gear 28.

Referring once again to FIG. 1, beveled ring gear 28 is rotatably mounted on bush bearing 29 which rides on hollow input shaft 11. As beveled ring gear 28 is rotated, the beveled pinion gear 27 of each threaded jack shaft 26 is rotated, raising or lowering all three sliding blocks 23 simultaneously. An interior, straight-cut ring gear 30 rigidly affixed to said beveled ring gear and meshes with a straight-cut pinion gear 31 which is rigidly affixed to threaded control shaft 32, which is rotatably mounted within said main support frame 25 and collared to prevent longitudinal movement. Sliding screw follower 33 is drilled and tapped and fitted to the threaded section of threaded control shaft 32. Said follower is coupled to sliding shaft 36 by means of two thrust collars 34 and 35 which are rigidly affixed to one end of sliding shaft 36. Said sliding shaft has a rack gear 37 cut into a section at its opposite end. Said rack gear meshes with the splines on threaded, splined adjustment shafts 12 and 13. Hence, rotational movement of threaded control shaft 32 creates simultaneous longitudinal movement of sliding shaft 37 and rotational movement of beveled ring gear 28, which are converted respectively to a counterbalanced adjustment of the two variable-throw eccentrics and an adjustment in cylinder assembly position to maintain the compression ratio of the pump constant as its stroke is changed. The gear sets, of course, are selected to provide this constant-compression-ratio relationship.

If the valved output from the cylinders mounted about a single eccentric is fed to a hydraulic servo piston, the linear velocity of the piston in one direction can be infinitely varied by varying the stroke of the eccentric on one side of the null point; linear velocity in the other direction is similarly controllable on the other side of the null point. At the null point, the piston remains hydraulically locked in place.

A volumetric measuring device for infinitely varying the mixture of two liquids may be constructed by mounting two variable-throw eccentrics—both coupled by a common rack gear and adjustment shafts on a common input shaft so that the maximum stroke of one conincides with the minimum stroke of the other. This adjustment point equates with a 100 percent concentration by volume of one of the liquids. At another point, when the strokes are equal, the concentration of the same liquid will be 50 percent. As adjustment of the ecentrics is continued, the concentration of that liquid will fall to zero percent.

While the preferred embodiment of the invention has been disclosed, other embodiments may be devised and modifications made within the spirit of the invention and within the scope of the appended claims. For example, although the preferred embodiment of the invention has been described as a radially-configured pump, the concept is applicable to a pump, engine or motor of inline or banked-"V" cylinder configuration.

What is claimed is:

1. A variable-stroke reversible pump comprising:

a variable-throw eccentric comprising a tubular input shaft having a diametrical threaded hole, a threaded splined adjustment shaft which is screwed into the threaded hole in said input shaft, a hollow connecting-rod journal moving in a plane perpendicular to said tubular input shaft, having bearing races which are anchored at diametrically opposed points in said journal, said bearing races mounting the opposite ends of said adjustment shaft;

a slidable rack gear mounted within said tubular input shaft and operating on the splines of said adjustment shaft for rotating said adjustment shaft while said variable-throw eccentric moves in continuous angular motion;

at least one piston mounted slideably in a closed-fitting cylinder capped by a cylinder head; and a connecting rod coupling said piston to said connecting-rod journal.

2. The variable-stroke constant-compression-ratio reversible pump of claim 1 wherein at least two cylinders are positioned radially about the axis of said hollow input shaft, the axes of said at least two cylinders lying in a plane perpendicular to said axis of said hollow input shaft.

3. The variable-stroke constant-compression-ratio reversible pump of claim 2 wherein the reciprocal motion for the pistons operating in said at least two cylinders is provided by a single variable eccentric.

4. The variable-stroke constant-compression-ratio reversible pump of claim 3 wherein only one of said pistons is attached to a main connecting rod having a bearing race which surrounds said hollow connecting rod journal, each of the remaining pistons attached to a connecting rod pivotally mounted to said main connecting rod.

* * * * *